United States Patent [19]

Burgess

[11] 4,073,272

[45] Feb. 14, 1978

[54] THROTTLE CONTROL SYSTEM

[75] Inventor: Ronald R. Burgess, Corunna, Mich.

[73] Assignee: Tom McGuane Industries, Inc., Farmington Hills, Mich.

[21] Appl. No.: 730,805

[22] Filed: Oct. 8, 1976

[51] Int. Cl.[2] ..... F02D 11/08

[52] U.S. Cl. ..... 123/103 B; 123/103 E; 123/DIG. 11; 251/61.4; 92/165 PR

[58] Field of Search ..... 123/103 R, 103 B, 103 E, 123/DIG. 11, 198 DB, 117 A; 251/61.4; 261/DIG. 18, 65; 92/101-165 PR

[56] References Cited

U.S. PATENT DOCUMENTS

| | | | |
|---|---|---|---|
| 2,956,549 | 10/1960 | Malpass | 92/165 PR |
| 3,603,297 | 9/1971 | Sherwin et al. | 123/103 E |
| 3,741,177 | 6/1973 | Schultz | 123/DIG. 11 |
| 3,847,131 | 11/1974 | Hisatomi | 123/198 DB |

*Primary Examiner*—Charles J. Myhre
*Assistant Examiner*—Craig R. Feinberg
*Attorney, Agent, or Firm*—Barnes, Kisselle, Raisch & Choate

[57] ABSTRACT

A throttle control system comprising a throttle member movable with the throttle and yieldingly urged toward a throttle closed position and a vacuum controlled positioning assembly including a housing, a diaphragm within the housing dividing the housing into two chambers. A stem is mounted on the diaphragm and extends from the housing through an opening. The plunger has a first cylindrical portion and a second portion including opposed parallel flat surfaces connected by arcuate cylindrical portions having the same diameter as the first cylindrical portion. The opening has longitudinally spaced portions. One portion is cylindrical and generally complementary to said first cylindrical portion of the plunger and the other portion has the same configuration as the second portion of the plunger. A spring yieldingly urges the diaphragm in a direction to retract the plunger inwardly of the housing. The outer edge of the plunger is adapted to engage the throttle member to retard the movement thereof against the action of the spring when vacuum is applied to the second chamber of the housing.

21 Claims, 5 Drawing Figures

THROTTLE CONTROL SYSTEM

This invention relates to throttle control systems.

BACKGROUND AND SUMMARY OF THE INVENTION

In internal combustion engines it has heretofore been suggested that operation of the engine from the standpoint of smoothness of operation and reduction in contaminants and impurities can be improved by utilizing a throttle positioning assembly which functions to maintain the throttle at a high idle position when it is released suddenly at a high vehicle speed and to permit the throttle to move to a throttle-closed position when the engine approaches normal idle rpm.

Such a throttle control assembly generally comprises a housing with a diaphragm therein separating the housing into a first and second chamber, the second chamber being connected to the vacuum created by engine operation through an intermediate control valve. A plunger or stem is usually connected to the diaphragm and extends through one wall of the housing into contact with the throttle stop when the throttle is closed and the positioner is energized. A spring normally urges the diaphragm and in turn the plunger against the action of the vacuum. The plunger is usually fastened to the diaphragm by rivets or other means and it has been found that adjustment of the plunger often causes the connection to the diaphragm to be torn or weakened. In an effort to improve this, it has heretofore been suggested that a rectangular or hexagonal portion be extending through a corresponding non-cylindrical hole extending through one wall of the housing to resist rotation of the plunger relative to the diaphragm. Such a construction has provided for improved operation. However, penetration of the diaphragm still was a source of potential leaks. In a further effort to improve the construction, it has been suggested that the plunger be attached to the diaphragm in a manner such that the plunger penetrates the diaphragm and that the plunger have a square cross section extending through the wall of the housing. This has produced improved construction, but there has been still a tendency to bind as the plunger moves back and forth within the housing. Such a throttle control assembly is shown, for example, in U.S. Pat. No. 3,618,582.

This invention is intended to provide a throttle control assembly which obviates the disadvantages achieved by prior throttle control assemblies.

DESCRIPTION

Figure 1:
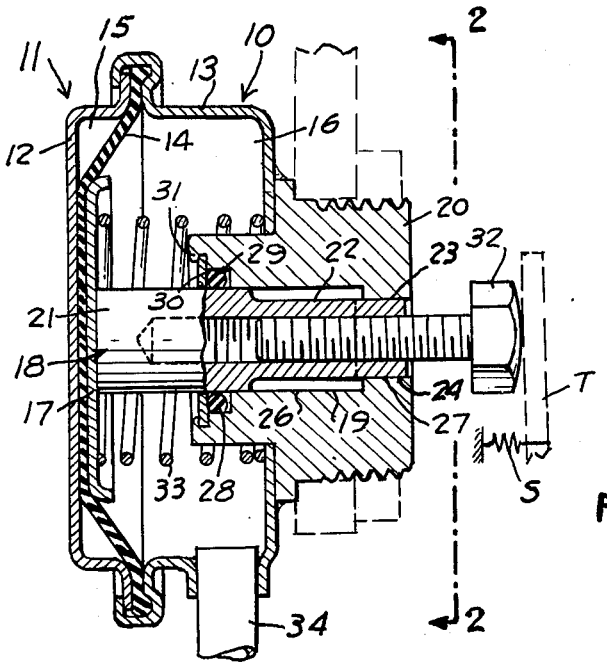
FIG. 1 is a longitudinal sectional view through a throttle control assembly embodying the invention.

Referring to FIG. 1, the system embodying the invention comprises a throttle member T that is movable with the throttle of the vehicle and is yieldingly urged by a spring S toward a throttle closing position. A vacuum operating assembly 10 is associated with the throttle T and functions to retard the movement of the throttle member T toward a throttle-closing position.

Figure 2:
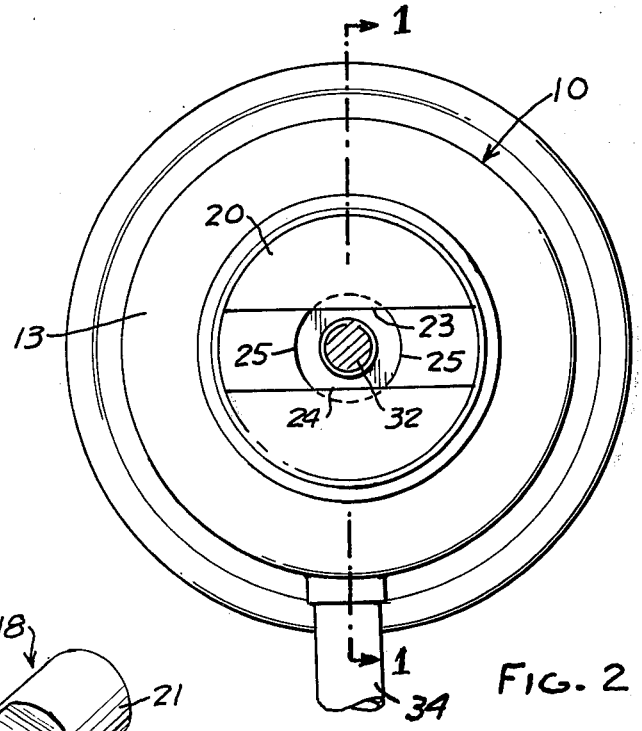
FIG. 2 is a sectional view taken along the line 2—2 in FIG. 1.
Figure 3:
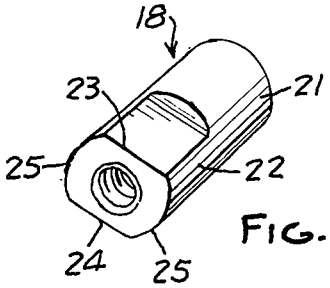
FIG. 3 is a perspective view of a part of the assembly shown in FIGS. 1 and 2.

The throttle positioning assembly 10 includes a housing 11 comprising halves 12, 13 made of sheet metal or the like which are joined together to clamp a diaphragm 14 of flexible material and thereby divide the housing into a first chamber 15 and a second chamber 16. A washer or plate 17 contacts one side of the diaphragm 14 and supports a stem or plunger 18 that extends axially through an opening 19 in a wall 13 of the housing 11. The opening 19 is provided in a fitment 20 fixed on the wall of the housing half 13. The stem or plunger 18 includes a first cylindrical portion 21 and a second non-circular portion 22 which has opposed flat surfaces 23, 24 connected by arcuate surfaces 25 that have the same diameter as the first cylindrical portion 21 (FIGS. 2, 3).

The opening 19 includes a first portion 26 which has a cylindrical configuration conforming to the cylindrical portion 21 and a second portion 27 having opposed flat surfaces corresponding to the opposed flat surfaces 23, 24 of the second portion 22 of the plunger. Portion 27 is achieved by milling a slot transversely across the end of the fitment 20. An O-ring 28 is provided in a shoulder 29 in the inner end of fitment 20 and is retained by a ring 30 held in position by bending over or peening portions of the fitting 20 as at 31.

A threaded bolt 32 is threaded into the outer end of the plunger 18 so that the head of the bolt is adapted to be engaged by the throttle member T.

A spring 33 normally urges the plunger 18 and washer 17 to the left carrying diaphragm 14 to the left as shown in FIG. 1 against the action of vacuum through an opening 34.

When the assembly 10 is in position, the idling of the engine can be readily adjusted without transmitting torque to the diaphragm, by rotating bolt 32.

Figure 4:
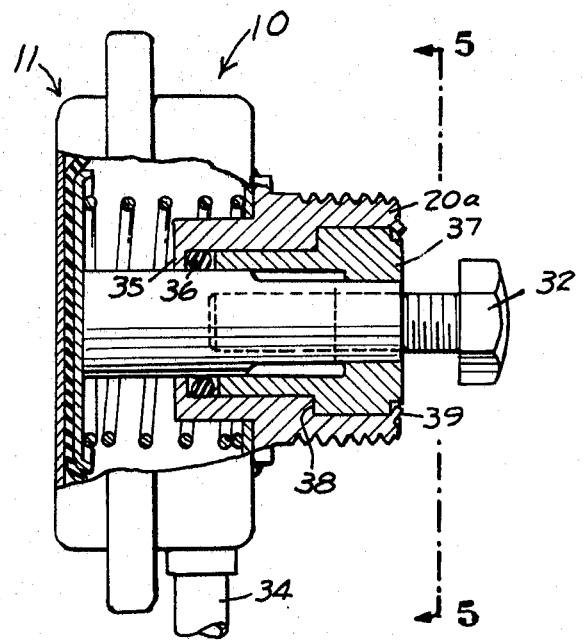
FIG. 4 is a part sectional side elevational view showing a modified form of throttle control assembly.
Figure 5:
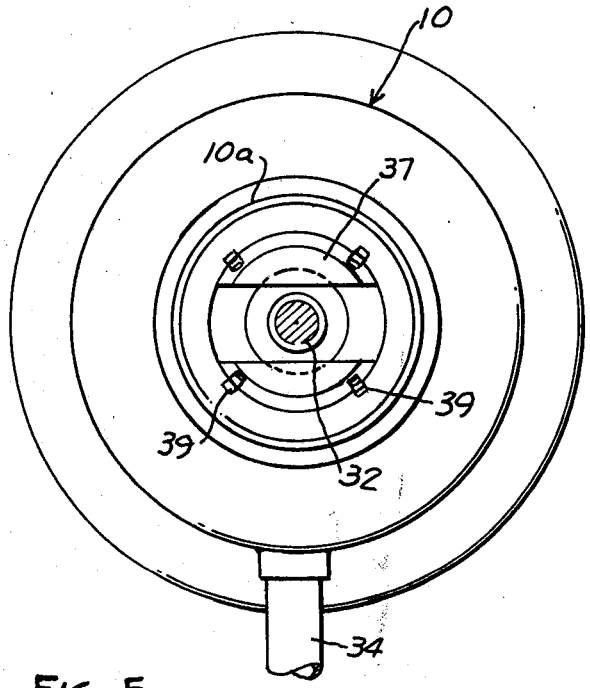
FIG. 5 is a fragmentary sectional view taken along the line 5—5 in FIG. 4.

In the form of the invention shown in FIGS. 4 and 5 the fitting **20*a* is provided with an inwardly extending shoulder 35 which is engaged by O-ring 36 and a second member 37 that extends inwardly and engages a shoulder 38 and O-ring 36 on the fitting 20*a*. The second member 37 is retained by peened elements 39 on the fitment. In all other respects the throttle control assembly is identical to that shown in FIGS. 1–3**.

I claim:

1. A vacuum controlled positioning assembly including a housing, piston means within the housing dividing the housing into two chambers, a plunger engaging the piston means and extending from the housing, said housing having an opening therein, said plunger extending through said opening, said plunger in said housing having a first cylindrical portion and a second portion including opposed parallel flat surfaces connected by arcuate cylindrical portions having the same diameter as the first cylindrical portion, said opening having longitudinally spaced portions, one said portion being cylindrical and generally complementary to said first cylindrical portion of said plunger and the other said portion having the same configuration as said second portion of said plunger, a spring yieldingly urging said piston means in a direction to retract the plunger inwardly of said housing, the outer edge of said plunger being adapted to engage a throttle member to retard the movement thereof against the action of the spring when vacuum is applied to the second chamber of the housing.

2. The combination set forth in claim 1 wherein said opening in said housing is formed by a fitting.

3. The combination set forth in claim 2 wherein said fitting has said first and second portions of said opening formed therein.

4. The combination set forth in claim 3 including a seal associated with the first portion of said fitting and engaging the first cylindrical portion of said plunger.

5. The combination set forth in claim 4 wherein said seal is retained by a ring.

6. The combination set forth in claim 3 wherein said seal is retained by an inwardly extending flange on said fitting.

7. The combination set forth in claim 6 wherein said fitting includes a second removable member providing access to said seal from a position exteriorly of said housing.

8. In a throttle control system, the combination comprising a throttle member movable with the throttle and yieldingly urged toward a throttle closed position, a vacuum controlled positioning assembly including a housing, piston means within the housing dividing the housing into two chambers, a plunger engaging the piston means and extending from the housing, said housing having an opening therein, said plunger extending through said opening, said plunger having a first cylindrical portion and a second portion including opposed parallel flat surfaces connected by arcuate cylindrical portions having the same diameter as the first cylindrical portion, said opening having longitudinally spaced portions, one said portion being cylindrical and generally complementary to said first cylindrical portion of said plunger and the other said portion having the parallel flat surfaces complementary to the surfaces of said second portion of said plunger, a spring yieldingly urging said piston means in a direction to retract the plunger inwardly of said housing, the outer edge of said plunger being adapted to engage said throttle member to retard the movement thereof against the action of the spring when vacuum is applied to the second chamber of the housing.

9. The combination set forth in claim 8 wherein said opening in said housing is formed by a fitting.

10. the combination set forth in claim 9 wherein said fitting has said first and second portions of said opening formed therein.

11. The combination set forth in claim 10 including a seal associated with the first portion of said fitting and engaging the first cylindrical portion of said plunger.

12. The combination set forth in claim 11 wherein said seal is retained by a ring.

13. The combination set forth in claim 4 wherein said seal is retained by an inwardly extending flange on said fitting.

14. The combination set forth in claim 13 wherein said fitting includes a second removable member providing access to said seal from a position exteriorly of said housing.

15. In a throttle control system, the combination comprising a throttle member movable with the throttle and yieldingly urged toward a throttle closed position, a vacuum controlled positioning assembly including a housing, a diaphragm within the housing dividing the housing into two chambers, a plunger engaging on the diaphragm and extending from the housing, said housing having an opening therein, said plunger extending through said opening, said plunger having a first cylindrical portion and a second portion including opposed parallel flat surfaces connected by arcuate cylindrical portions having the same diameter as the first cylindrical portion, said opening having longitudinally spaced portions, one said portion being cylindrical and generally complementary to said first cylindrical portion of said plunger and the other said portion having the parallel surfaces complementary to said surface of said second portion of said plunger, a spring yieldingly urging said diaphragm in a direction to retract the plunger inwardly of said housing, the outer edge of said plunger being adapted to engage said throttle member to retard the movement thereof against the action of the spring when vacuum is applied to the second chamber of the housing.

16. The combination set forth in claim 15 wherein said opening in said housing is formed by a fitting.

17. The combination set forth in claim 16 wherein said fitting has said first and second portions of said opening formed therein.

18. The combination set forth in claim 17 including a seal associated with the first portion of said fitting and engaging the first cylindrical portion of said plunger.

19. The combination set forth in claim 18 wherein said seal is retained by a ring.

20. The combination set forth in claim 17 wherein said seal is retained by an inwardly extending flange on said fitting.

21. The combination set forth in claim 20 wherein said fitting includes a second removable member providing access to said seal from a position exteriorly of said housing.

* * * * *